United States Patent [19]

Nelson et al.

[11] 4,318,491

[45] Mar. 9, 1982

[54] TOROIDAL PRESSURE VESSEL

[76] Inventors: Richard E. Nelson, 53 E. Tacoma, Clawson, Mich. 48017; Thomas J. Starr, 31409 Mound Rd., Apt. F, Warren, Mich. 48092

[21] Appl. No.: 137,983

[22] Filed: Apr. 7, 1980

[51] Int. Cl.[3] ..... B65D 90/00

[52] U.S. Cl. ..... 220/1 B; 138/148; 285/156; 220/3; 220/288

[58] Field of Search ..... 220/1 R, 1 B, 3, 288, 220/DIG. 13; 228/154, 184, 215; 29/157 A, 463; 285/156, 286, 287, 370, 417

[56] References Cited

U.S. PATENT DOCUMENTS 3,392,994 7/1968 Moore ..... 285/156

3,903,931 9/1975 Moulin et al. ..... 220/3 X

*Primary Examiner*—George T. Hall

*Attorney, Agent, or Firm*—Basile, Weintraub & Hanlon

[57] ABSTRACT

A toroidal shaped container including a body made from tubing and formed into a ring is disclosed. The tube is bent so that the tube ends are aligned and spaced apart a distance with a closure piece inserted between the aligned ends and welded thereto to form a closed container. In a preferred embodiment the closure piece includes a boss projecting radially from the closure piece with an inwardly extending threaded aperture formed in the boss penetrating the interior of the pressure vessel.

4 Claims, 8 Drawing Figures

Fig-5
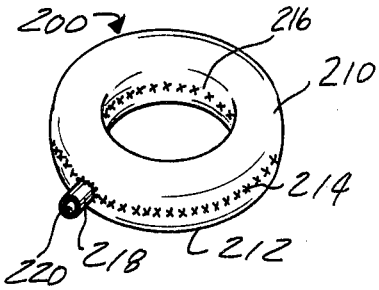
Fig-1
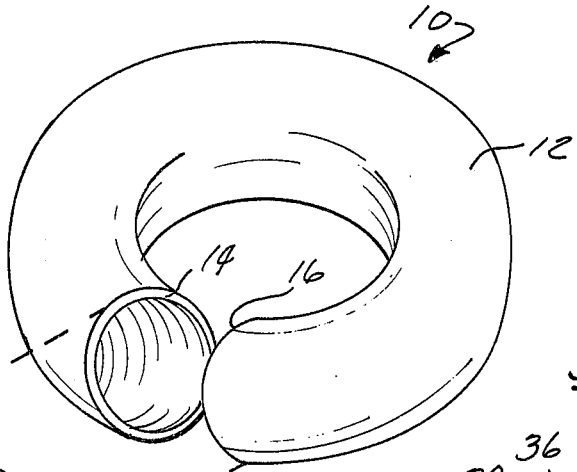
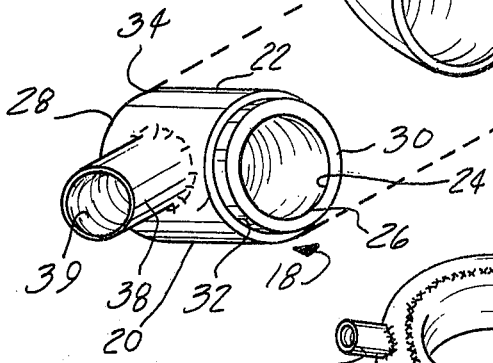
Fig-3
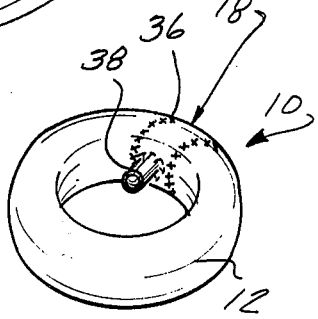
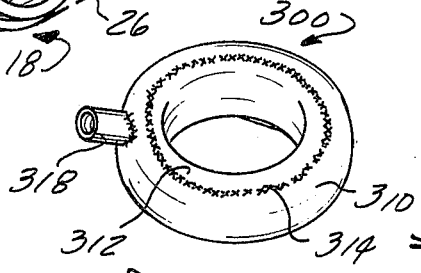
Fig-7
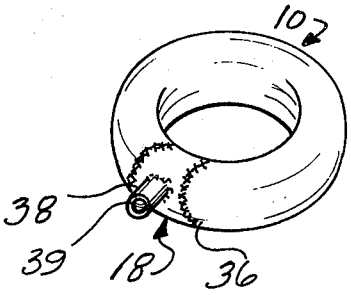
Fig-2
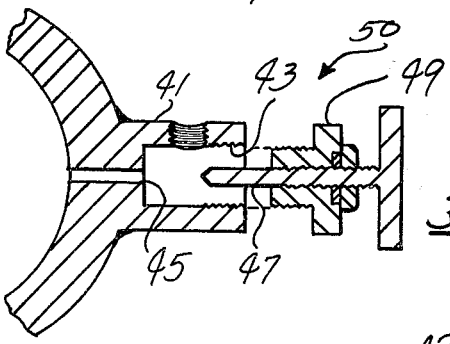
Fig-6
Fig-4
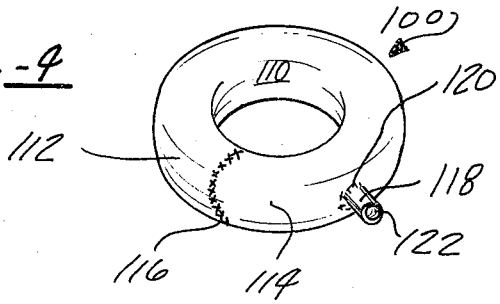
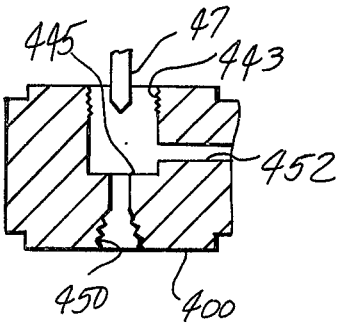
Fig-8

TOROIDAL PRESSURE VESSEL

BACKGROUND OF THE INVENTION

I. Field of the Invention

The present invention relates generally to the field of pressure vessels, and in particular, the present invention is concerned with pressure vessels formed from tubing with the tubing bent to form a ring with the tube ends aligned and joined together to form a toroidal shaped enclosure for containing fluid under pressure.

II. Cross Reference to Related Applications

This application is related to copending patent application Ser. No. 106,929 filed Dec. 26, 1979; entitled Portable Modular Beverage Dispenser.

III. Description of the Prior Art

Pressure vessels have been formed in a wide variety of configurations, such as the interconnected and intersecting hollow spheroids shown in U.S. Pat. Nos. 2,106,494, and 2,171,972 or the oblate shell shown in U.S. Pat. No. 2,522,401.

It is also known to form high pressure vessels from a length of tubing wound in a helical form as shown in U.S. Pat. No. 3,208,449. U.S. Pat. Nos., 2,336,140; 3,432,060; 3,502,075; and 3,505,996 show pressure tanks formed of a tube wound upon itself in a plurality of turns. U.S. Pat. No. 2,330,118 shows a reaction chamber formed with parallelly disposed conduits which are joined at either end by a pair of curved conduits to form a substantially oval shaped chamber. Inlet and outlet conduits are connected to either of the curved conduits. U.S. Pat. No. 2,314,442 discloses a toroidal pressure vessel formed from a plurality of plates riveted together. Upper and lower walls extending diametrically across the center opening define a second pressure vessel.

SUMMARY OF THE INVENTION

The present invention, which will be described in greater detail subsequently, comprises a toroidal pressure vessel for containing fluids under pressure for the subsequent use of the fluid in a controlled manner. The toroidal pressure vessel is particularly adapted for use as a gas storage vessel for charging the beverage container of a beverage dispenser device as described in the referenced copending patent application. The toroidal shaped pressure vessel of the present invention comprises a body made from tubing and formed into a ring with the tubing ends aligned and spaced apart a distance. In a preferred embodiment a closure piece is welded between the aligned ends to form a closed container. The closure piece is made from heavy wall tubing preferably having a wall thickness greater than the wall thickness of the tubing from which the body is formed with a reduced diameter formed along each end of the closure piece to produce a pair of opposed shoulders. The reduced diameter is configured to snugly engage the tubing inside diameter with the shoulders abutting the tube ends. A weld deposited along the abutting ends and shoulders produces a gas tight structure. In the preferred embodiment, a boss is formed on the closure piece which boss extends radially outward or rearward therefrom and includes a threaded aperture formed to enter the interior of the pressure vessel and receive a pressure fitting.

It is therefore a primary object of the present invention to provide a new and improved pressure vessel.

It is a further object of the present invention to provide a new and improved pressure vessel formed in the shape of a toroid.

It is yet another object of the present invention to provide a new and improved pressure vessel formed in a toroidal shape including a threaded boss attached to the toroid for attaching a pressure fitting.

It is a further object of the present invention to provide a new and improved pressure vessel formed in the shape of a toroid having a pressure fitting receiving boss positioned at the interior of a toroid to prevent fitting damage.

It is yet another object of the present invention to provide a toroidal shaped pressure vessel that can be conveniently stacked one on another for easy storage and transportation.

It is yet a further object of the present invention to provide a toroidal shaped pressure vessel for use as a gas charging device for portable beverage dispensers.

Further objects, advantages, and applications of the present invention will become apparent to those skilled in the art to which this invention pertains, when the accompanying description of one example of the best mode contemplated for practicing the invention is read in conjunction with the accompanying drawing.

BRIEF DESCRIPTION OF THE DRAWING

In the drawing like reference numbers refer to like parts throughout the several views, and wherein:

FIG. 1 illustrates an exploded perspective view of the preferred embodiment of the present invention;

FIG. 2 illustrates a perspective view of the toroidal pressure vessel of the present invention with the boss extending radially outward from the toroid;

FIG. 3 illustrates the pressure vessel of FIG. 1 with the boss extending radially inward toward the center of the toroid;

FIG. 4 illustrates another embodiment of the present invention wherein the toroid is made from tubing formed in a ring with the ends of the tube abutting and welded, and a boss welded to the ring extending radially outward from the toroid center;

FIG. 5 illustrates another embodiment of a toroidal pressure vessel with seams welded along an inner and outer periphery thereof;

FIG. 6 illustrates a cross sectional view of another embodiment of a boss configured to receive a stem and packing to form a shut-off valve;

FIG. 7 illustrates a toroidal pressure vessel with seams circumferentially disposed along an upper and lower portion; and FIG. 8 illustrates a cross sectional view of a thick-walled circular closure piece including an internally formed valve seat.

DESCRIPTION OF THE PREFERRED EMBODIMENTS

Referring now to the drawings, there is illustrated in FIG. 1 one example of the present invention in the form of a toroidal shaped pressure vessel 10. The toroidal pressure vessel 10 is adapted to store fluids under pressure for use in a controlled manner for useful purposes such as providing pressure for the liquid container associated with portable beverage dispensers.

The toroidal pressure vessel 10 includes a tubular body 12 formed in a shape of a ring with tube ends 14,16 aligned and spaced apart a distance. The toroidal pressure vessel 10 further comprises a closure piece 18 welded between the aligned ends 14,16 to form a closed container.

The closure piece 18 comprises a short tube 20 which exceeds in length the distance between the aligned ends 14,16 and having an outside diameter 22 equaling the diameter of the tubular body 12, and an inside diameter 24 less than the tubing inside diameter. A reduced diameter 26 is formed along the opposed ends 28,30 of the short tube 20 to produce a pair of opposed shoulders 32, 34. The reduced diameter 26 snugly engages the tubing inside diameter and the opposed shoulders 32,34 abut the tube ends 14,16. A weld 36 (FIG. 2) deposited along the abutting ends and shoulders forms a gas tight integrated structure. A boss 38 is formed on the closure piece 18 extending radially outward or inward a distance. A threaded aperture 39 is formed in the boss 38 extending to the interior of the pressure vessel and is configured to receive a pressure fitting. It is obvious to the skilled artisan that the closure piece may alternately be formed without the shoulders 32,34 if external means are provided to align the pieces before welding. Boss 38 maybe directed in any convenient manner including radially outward as illustrated in FIG. 2 or radially inward as illustrated in FIG. 3, or in any direction convenient to the apparatus with which the pressure vessel is utilized. It is also obvious to the skilled artisan that with the boss 38 directed radially inward toward the center of the toroid as illustrated in FIG. 3 the boss and subsequent fittings or pressure regulators attached thereto are protected from damage when the pressure vessel is accidently dropped. It is also apparent to the skilled artisan that a toroidal vessel as illustrated in FIGS. 2 and 3 may be conveniently stacked one upon another or may be hung on a horizontally projecting support producing a compact and convenient as well as safe storage for the pressure vessel. Conventional pressure bottles require racks and straps and screw-on valve covers for their storage to prevent damage to the valves and fittings attached thereto. Conventional pressure vessels or bottles can be accidently tipped over which may result in damage which allows the pressurized gas to escape and may also result in damage to the fittings, pressure regulators etc., that may be attached thereto. Also, persons in the vicinity may be injured due to the rocket effect produced when a valve is broken from a conventional cylinder.

Referring now to FIG. 4 of the drawing, there is illustrated at 100 another embodiment of the present invention in the form of a toroidal container formed from a tube 110 bent into the shape of a ring with the tube ends 112,114 abutting. A seam weld 116 joins the abutting tube ends 112,114 together to form an integrated gas tight structure. A boss 118 is welded to the tube 110 by a second weld 120 forming a gas tight integration of the boss 118 and the tube 110. It is obvious to the skilled artisan that the boss 118 may be welded in any position along the tube 110 and the boss 118 maybe pointed in any direction from radially outward to radially inward with reference to the center of the toroid. If the boss projects any direction but upward or downward, the toroids may be stacked one upon another for convenient and compact safe storage. A threaded aperture 122 is formed in the boss 118 extending to the interior of the pressure vessel for the attachment of pressure fittings such as valves and/or pressure regulators as required by the apparatus that uses the pressure vessel.

After the pressure vessel has been formed, the pressure vessel is preferably leak tested and prestressed to improve its dependability and to check for leaks. The prestressing and leak checking of the vessels is performed by first filling the vessel with a relatively incompressible fluid such as water. Then a pressure is imposed on the vessel to force the material in the toroid to exceed the yield strength of the metal forming the toroidal pressure vessel. The pressure is held for a period of time while all seams are checked for leaks, then the pressure is relieved, the vessel is drained, and made ready for filling with the pressurized fluid that the vessel is intending to store. The process of stressing the vessel to a pressure which exceeds the yield strength of the metal forming the toroidal pressure vessel tends to reduce the stress that the vessel attains in normal use. When the yield strength of the metal has been exceeded and then stress relieved, the vessel is then in compressive load. Adding the normal load associated with pressure within the vessel after prestressing first relieves the compressive stress and, as the pressure is further increased within the vessel, a tensile stress develops. This reduces the maximum tensile stress imposed on the vessel when it is at full pressure.

In another embodiment, a boss 41 may be utilized having a bore 43 and valve seat 45 formed therein to receive the stem 47 and gland 49 of a shut off valve as illustrated in FIG. 6. Such a configuration would reduce the size and cost of the pressure vessel.

FIG. 5 illustrates at 200 an alternate configuration for forming a toroidal pressure vessel. A pair of ring shaped halves 210,212 having a semi-circular cross-section are aligned in an opposed manner and welded together with a pair of horizontal seam welds 214,216 to form a toroid. A boss 218 having a threaded bore 220 entering the interior of the toroid is welded thereto. The boss 218 is configured to accommodate a pressure shut-off valve or other pressure fittings as required.

A convenient method for forming a circular tube to produce the toroid of FIG. 4 would be to produce a tubular spiral having several coils. The coils are then separated and aligned for welding using known cut off and pressing apparatus.

It is apparent to the skilled artisan that a toroid may be produced as illustrated at 300 in FIG. 7. As shown, an outer ring 310 of semi-circular cross-section is aligned with an inner ring 312 also of semi-circular cross-section and the rings are joined to a toroid shape by a top weld 314 and a bottom weld (not shown). A boss 318 is welded to the toroid in a known manner to connect pressure fittings thereto.

FIG. 8 illustrates a closure piece 400 interchangeable with the closure piece 18. The closure piece 400 is conveniently made from bar stock and has sufficient thickness to accommodate a threaded bore 443 and a valve seat 445. The bore 443 and seat 445 are configured to receive the stem 47 and gland 45 of the shut off valve illustrated in FIG. 6. A threaded aperture 450 is configured to receive pressure fittings and a pressure regulator. Bore 452 directs pressure from the toroid to the valve seat where the pressure can be released in a controlled manner by the stem 47. The heavy wall closure piece of FIG. 8 may also be employed to accommodate an internally formed threaded aperture for attaching pressure fittings thus eliminating the outward projecting boss.

It can thus be seen that the present invention has provided a new and improved toroidal pressure vessel for storing fluids under pressure. The pressure vessel of the present invention may be safely and conveniently stored by stacking the vessels one upon another or hanging them on a horizontally projecting support. The toroidal pressure vessel of the present invention with an inwardly directed boss can prevent damage to valves and other fittings attached thereto.

It should be understood by those skilled in the art to which this invention pertains, that other forms of the Applicant's invention may be had, all coming within the spirit of the invention and the scope of the appended claims.

Having thus described our invention what we claim is:

1.

a toroidal shaped container comprising:

a body made from tubing with an inside diameter and outside diameter formed into a ring with tube ends aligned and spaced apart a distance;

a closure piece welded between the aligned ends to form a closed container;

a short tube exceeding in length the distance between aligned ends, having an outside diameter equalling the tubing outside diameter, an inside diameter less than the tubing inside diameter, a reduced diameter formed along each end of the closure piece producing a pair of opposed shoulders, said reduced diameter snugly engaging the tubing inside diameter with the shoulders abutting tube ends, a weld deposited along the abutting ends and shoulders to form an integrated structure.

2. The container as defined in claim 1 further comprising:

a boss formed on the closure piece extending radially outward; and the boss including a threaded aperture formed therein to receive a pressure fitting.

3. The container as defined in claim 1 further comprising:

a boss formed on the closure piece;

a threaded bore formed in said boss with a valve seat in communication with said container formed at a bottom thereof;

a gland threadingly engaging said threaded bore, said gland including a seal and a threaded central bore axially aligned with said threaded bore;

a valve stem threadingly engaging said central bore;

a transverse bore in communication with said threaded bore, said transverse bore threaded to receive a pressure fitting; and wherein rotation of said valve stem in a first direction spaces said valve stem from said valve seat allowing communication between said threaded bore and the container, and rotation of said valve stem in a counter direction abuts said valve stem in a counter direction abuts said valve stern against said valve seat preventing communication between said container and said threaded bore.

4. The container as defined in claim 1 further comprising:

a boss formed on the closure piece extending radially inward toward the center of the Toroidal shaped container; and the boss including a threaded aperture formed therein to receive a fitting.

* * * * *

UNITED STATES PATENT OFFICE

CERTIFICATE OF CORRECTION

Patent No. 4,318,491 Dated March 9, 1982

Inventor(s) Richard Nelson Thomas J. Starr

It is certified that error appears in the above-identified patent and that said Letters Patent are hereby corrected as shown below:

In column 1, line 64 delete "rearward" and insert --inward--.

In column 6, claim 3 line 23 delete "stern" and insert --stem--.

Signed and Sealed this

*Seventeenth* Day of *August 1982*

[SEAL]

*Attest:*

GERALD J. MOSSINGHOFF

*Attesting Officer*

*Commissioner of Patents and Trademarks*